US006339287B1

(12) United States Patent
Sarver et al.

(10) Patent No.: US 6,339,287 B1
(45) Date of Patent: Jan. 15, 2002

(54) FLUORESCENT LAMP CONTAINING A MERCURY ZINC AMALGAM AND A METHOD OF MANUFACTURE

(75) Inventors: James F. Sarver, Chesterland, OH (US); Duane A. Stafford, Champaign, IL (US); Steven C. Hansen; Timothy R. Brumleve, both of Urbana, IL (US)

(73) Assignee: Advanced Lighting Technologies, Inc., Solon, OH (US)

( * ) Notice: Subject to any disclaimer, the term of this patent is extended or adjusted under 35 U.S.C. 154(b) by 0 days.

(21) Appl. No.: 08/299,292

(22) Filed: Sep. 1, 1994

Related U.S. Application Data

(63) Continuation-in-part of application No. 08/016,887, filed on Feb. 12, 1993, now abandoned.

(51) Int. Cl.[7] ..... H01J 61/28

(52) U.S. Cl. ..... 313/490; 313/565; 313/564; 313/552; 252/181.1; 252/181.6

(58) Field of Search ..... 313/490, 564, 313/565, 552; 252/181.1, 181.2, 181.6

(56) References Cited

U.S. PATENT DOCUMENTS

| | | | | | |
|---|---|---|---|---|---|
| 2,467,687 | A | * | 4/1949 | Noel | 313/639 X |
| 3,336,502 | A | * | 8/1967 | Gillatt | |
| 3,526,804 | A | * | 9/1970 | Evans et al. | |
| 4,145,634 | A | * | 3/1979 | Evans et al. | 313/490 |
| 4,216,178 | A | * | 8/1980 | Anderson | 264/9 |
| 4,698,549 | A | * | 10/1987 | Hammer et al. | 313/490 |
| 4,924,142 | A | * | 5/1990 | Kaldenhoven | 313/490 |

* cited by examiner

*Primary Examiner*—Ashok Patel
(74) *Attorney, Agent, or Firm*—Carter, Ledyard & Milburn

(57) ABSTRACT

A fluorescent lamp containing zinc amalgam and a method of precisely controlling the amount of mercury introduced into a temperature controlled fluorescent lamp. Precise quantities of mercury may be introduced into a fluorescent lamp in the form of solid zinc amalgam pellets that are in a metastable, non-equilibrium state.

25 Claims, 2 Drawing Sheets

FLUORESCENT LAMP CONTAINING A MERCURY ZINC AMALGAM AND A METHOD OF MANUFACTURE

This is a continuation-in-part of application Ser. No. 08/016,887 filed Feb. 12, 1993.

BACKGROUND OF THE INVENTION

The present invention relates to conventional fluorescent layers in which the mercury vapor pressure is controlled by controlling the temperature of the lamps that heretofore have been dosed with liquid mercury, and more particularly to such lamps containing mercury in the form of a zinc amalgam that, in contrast to the predicted equilibrium condition, is in a metastable, non-equilibrium state.

All fluorescent lamps contain mercury which is vaporized during lamp operation. The mercury vapor atoms efficiently convert electrical energy to ultraviolet radiation with a wavelength of 253.7 nm when the mercury vapor pressure is in the range of approximately $2\times10^{-3}$ to $2\times10^{-2}$ torr (optimally about $6\times10^{-3}$ torr). The ultraviolet radiation is in turn absorbed by a phosphor coating on the interior of the lamp wall and converted to visible light. The temperature of the coldest spot on the inner wall of the lamp when the lamp is operating is referred to as the "cold spot temperature" and will determine the mercury vapor pressure within the lamp.

When a lamp containing only mercury operates with a cold spot temperature above about 40° C., the mercury vapor pressure will exceed the optimal value of $6\times10^{-3}$ torr. As the temperature increases, the mercury vapor pressure increases and more of the ultraviolet radiation is self-absorbed by the mercury, thereby lowering the efficiency of the lamp and reducing light output.

The mercury vapor pressure may be maintained within the desired range either by controlling the cold spot temperature of the lamp (hereinafter referred to as "temperature control") or by introducing other metallic elements into the lamp in the form of amalgams that maintain the mercury vapor pressure (hereinafter referred to as "amalgam control"). For example, fluorescent lamps that have cold spot temperatures above about 75° C., such as some types of small diameter, low wattage fluorescent lamps generally known as "compact" fluorescents, are amalgam controlled in that they typically require two or more elements in addition to mercury which may be introduced into the lamp as solid ternary or multicomponent amalgams. Such amalgam controlled lamps rely on establishment of thermodynamic equilibrium for proper lamp operation (see, for example, U.S. Pat. No. 4,145,634 issued Mar. 20, 1979 to Evans, et al.).

The present invention is directed to temperature controlled fluorescent lamps.

Temperature controlled fluorescent lamps may operate with a cold spot temperature below about 75° C. (typically ranging from 20° to 75° C.) and desirably 40° C. to 60° C. Such lamps are also referred to as "low temperature" fluorescent lamps.

In temperature controlled lamps (e.g., ceiling mounted fluorescent lamps) the mercury is typically introduced into the lamp as a liquid in an amount related to the wattage and rated life of the lamp. For example, 10–15 milligrams of liquid mercury are typically needed to attain an average rated life of 20,000 hours for a 40 watt fluorescent lamp.

However, the high speed, automated manufacturing processes typically used to dose each lamp with liquid mercury lack precision because of the nature of the liquid mercury, the length and configuration of the path by which introduced, and the atomization of the mercury by the high velocity puff of inert gas used to effect introduction. As a result of the variability in the amount of mercury which reaches the lamp, a considerable excess of liquid mercury is used to insure that at least the minimum amount of liquid mercury is introduced into each lamp. Some of the known manufacturing processes allot an average of three to five times the amount of liquid mercury needed to achieve average rated life. Thus, most lamps receive far more mercury than is needed, even up to ten times the amount needed, to achieve the average rated life.

This use of excessive amounts of liquid mercury is wasteful and may produce very unfavorable consequences. For example, only part of the total amount of liquid mercury introduced into the lamp is converted to vapor when the lamp is operating leaving droplets of liquid mercury that cause dark spots on the lamp that are aesthetically undesirable. Further, and perhaps more significantly, mercury is toxic and lamp disposal is becoming a significant issue throughout the world. Thus, it is clearly desirable to manufacture fluorescent lamps with the minimum amount of mercury needed to meet the average rated life.

Accordingly, it is an object of the present invention to obviate many of the above discussed problems and to provide a novel fluorescent lamp which contains a controlled amount of mercury.

It is another object of the present invention to provide a novel temperature controlled fluorescent lamp which contains mercury in the form of a zinc amalgam.

It is yet another object of the present invention to provide a novel fluorescent lamp in which mercury is introduced into the lamp in the form of a solid binary amalgam and which retains most of the second constituent of the binary amalgam (e.g., zinc) in solid form during lamp operation.

It is still another object of the present invention to provide a novel lamp fill material for a temperature controlled fluorescent lamp that is solid and easily handled at temperatures below about 40° C.

It is a further object of the present invention to provide a novel method of introducing a precise amount of mercury into a temperature controlled fluorescent lamp.

It is yet a further object of the present invention to provide a novel method of dosing a fluorescent lamp with a solid, reducing the total mercury by allowing more accurate and reliable dosing.

These and many other objects and advantages of the present invention will be readily apparent to one skilled in the art to which the invention pertains from a perusal of the claims, the appended drawings, and the following detailed description of preferred embodiments.

DESCRIPTION OF PREFERRED EMBODIMENTS

Figure 1:
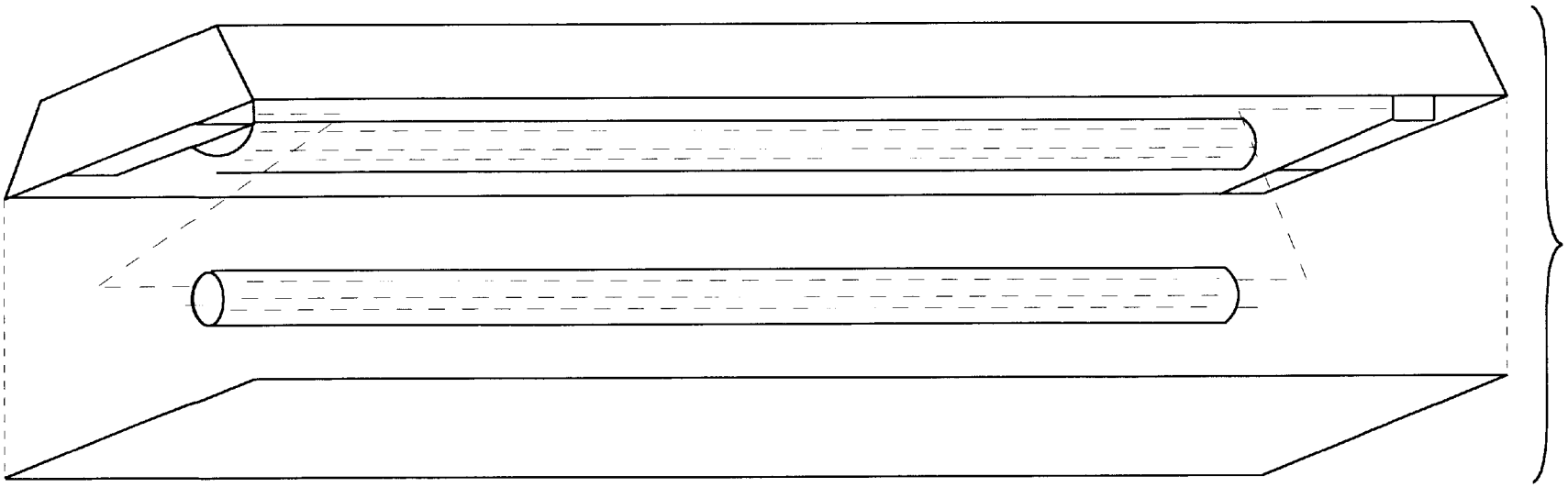
FIG. 1 is a pictorial view of one embodiment of the lamp of the present invention.

One embodiment of the novel fluorescent lamp of the present invention is illustrated in FIG. 1. It may be of standard size suitable for installation and use in conventional ceiling fixtures and contains mercury in the form of a zinc amalgam.

The amalgam may be binary, that is, consisting only of zinc and mercury (and with such minor impurities as may be introduced in the manufacturing process), or may consist substantially of zinc and mercury with a small portion (typically less than about 10 weight percent) of such other materials as may be appropriate (for example, bismuth, lead, indium, cadmium, tin, gallium, strontium, calcium and/or barium). The amalgam is desirably better than 99% pure and generally free of oxygen and water.

The amalgam is desirably about 5 to 60 weight percent mercury (about 3 to 33 atomic percent), with 40 to 60 weight percent mercury being preferred to reduce the amount of zinc introduced into the lamp. As shown in the published zinc-mercury phase diagram of FIG. 2, the amalgam in the desired percent weight range is predicted to be a solid at room temperature, to begin melting between 20° C. and 42.9° C., and to be completely molten between 280° C. (60 weight percent) and 400° C. (5 weight percent). As discussed in more detail below, the amalgam may not have the predicted characteristics, and may not be at equilibrium. The amalgam may be in a metastable, non-equilibrium state.

Figure 2:
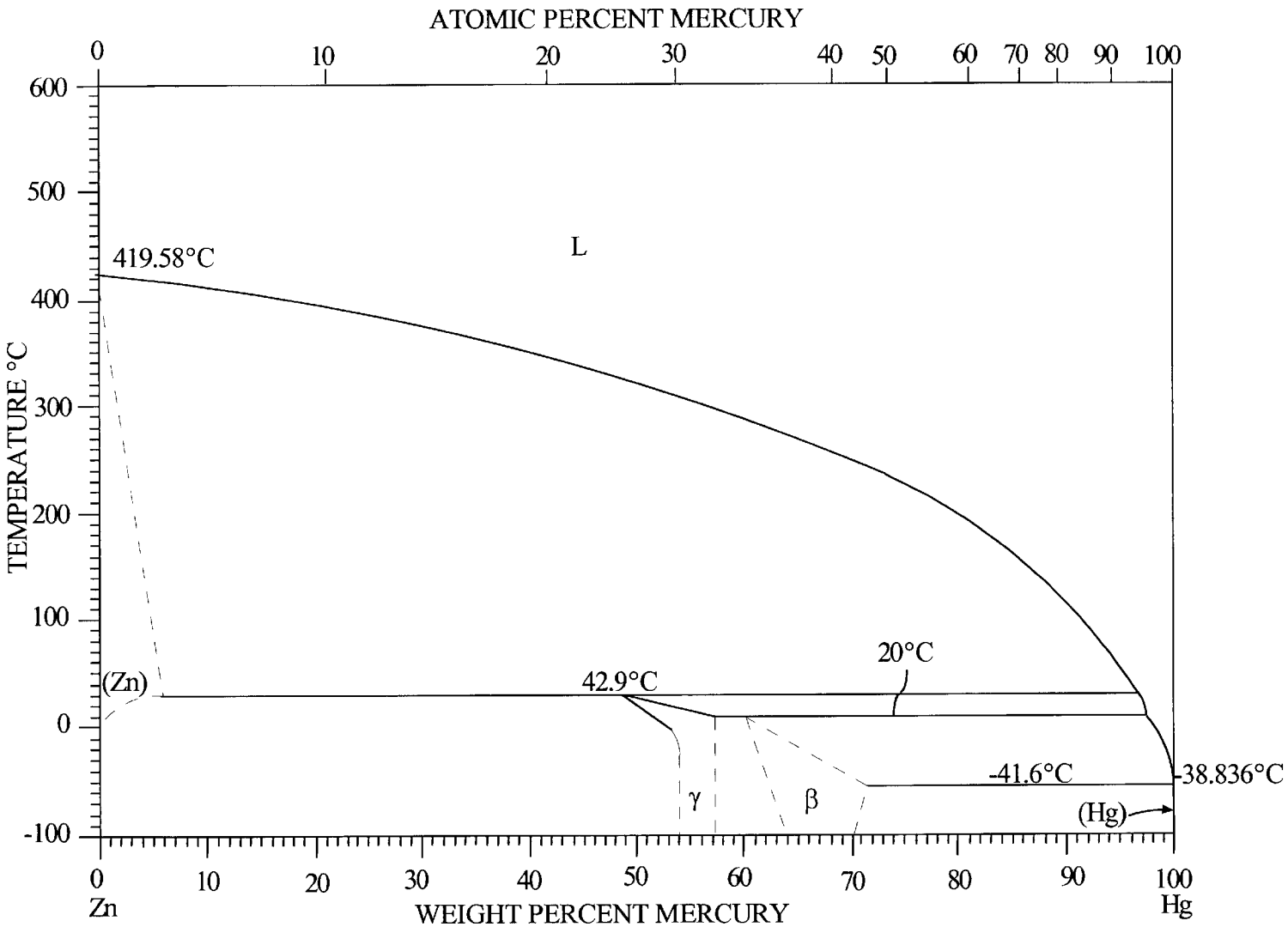
FIG. 2 is the published zinc-mercury equilibrium phase diagram.

With continued reference to FIG. 2, the equilibrium binary amalgam above 42.9° C. consists of a liquid phase containing a relatively small portion of the zinc in solution and a solid phase containing the balance of the zinc in a solid solution. For example, when the temperature of a 50 weight percent mercury amalgam exceeds 42.9° C., about one-half the amalgam is in a liquid phase producing a pool that is about 95% mercury by weight. This mercury rich liquid provides sufficient mercury vapor for efficient lamp operation. The amalgam which remains in the solid phase contains more than 90% zinc by weight. These conditions are typically achieved during lamp manufacture and operation.

As shown in the equilibrium phase diagram of FIG. 2, the 50 weight percent zinc-mercury amalgam is solid below 42.9° C. In contrast to the liquid mercury used in conventional temperature controlled fluorescent lamps, the amalgam of the present invention is a solid at room temperature so that it may be accurately dispensed and conveniently stored.

Because the amalgam is a solid at room temperature, the amount of amalgam that is to be introduced into a lamp may be easily quantified and dispensed. For example, small pellets of generally uniform mass and composition may be formed with any shape that is appropriate for the manufacturing process, although spheroidal pellets are the most easily handled and are thus preferred. Pellet diameter is desirably about 200 to 2000 microns.

Spheroidal pellets of generally uniform mass and composition may be made by rapidly solidifying or quenching the amalgam melt, such as by the apparatus and processes disclosed in U.S. Pat. No. 4,216,178 dated Aug. 5, 1980 (and those patents issuing from related applications), all assigned to the assignee of the present invention. The disclosure of said patents is hereby incorporated herein by reference.

These processes can be used to manufacture spheroidal pellets of predetermined and uniform mass (±10%) in the range from 0.05 milligrams to 25 milligrams. Other techniques for making the pellets, such as die casting or extrusion, are known and may be used. The pellets may be weighed, counted or measured volumetrically and introduced into the lamp by means of existing devices or other yet to be developed techniques. For example, a lamp that requires 10 mg of mercury may use 10 pellets, each 50 weight percent mercury and weighing 2 milligrams, or it may use one 20 milligram pellet of similar composition.

The zinc amalgam pellets manufactured by the rapid solidification or quenching processes discussed above have a structure that is different from that obtained by equilibrium freezing. That is, they do not necessarily melt or freeze in accordance with the published zinc-mercury phase diagram shown in FIG. 2. For example, the pellets have a partial zinc-rich exterior shell, and an interior with a random distribution of zinc-rich islands in a mercury-rich matrix. The intergranular regions are wetted with a mercury-rich liquid that remains stable (i.e., does not approach equilibrium) in the liquid phase when the pellets are stored at about 20° C. for several years even though the equilibrium phase diagram (FIG. 2) predicts that all phases are solid below 42.9° C. The rapidly solidified pellets have a porous structure that permits rapid gaseous diffusion of mercury vapor from the interior of the pellets. Further, the rigid structure of the pellets is maintained at temperatures up to 175° C.

It has been found that the vapor pressure of the mercury in the lamps at temperatures over 42.9° C. is enhanced over that which would be expected by thermodynamic calculations, a finding consistent with the non-equilibrium structure of the pellets. At temperatures below 42.9° C. the mercury vapor pressure is greater than 93% that of pure mercury, a finding consistent with the intergranular regions of the pellets that are wetted with a mercury-rich liquid. Thus, lamps dosed with the amalgam pellets have a mercury vapor pressure, and more significantly lamp performance, comparable to that of lamps dosed with pure liquid mercury, while providing ease and accuracy of dosing not available in liquid mercury dosed lamps. In contrast to amalgam controlled lamps, equilibrium of the amalgam need not be established.

Further, the porous structure allows rapid release of the mercury and rapid lamp start. The stability of this nonequilibrium structure indicates that the lamps of the present invention will operate over their rated life without mercury starvation and without recombination of released mercury with the pellets. The rigidity of the structure up to 175° C. improves manufacturability, even at the high temperatures that may be encountered in a manufacturing plant.

While preferred embodiments of the present invention have been described, it is to be understood that the embodiments described are illustrative only and the scope of the invention is to be defined solely by the appended claims when accorded a full range of equivalence, many variations and modifications naturally occurring to those skilled in the art from a perusal hereof.

What is claimed is:

1. A fluorescent lamp which does not rely on amalgamative metal to control mercury vapor pressure characterized in that mercury in the lamp is in the form of a zinc amalgam.

2. The lamp of claim 1 wherein said amalgam is about 40 to 60 weight percent mercury.

3. The lamp of claim 1 wherein said lamp has a cold spot operating temperature of between about 40° and 60° C.

4. The lamp of claim 1 wherein said amalgam is in the form of one or more pellets, each with mercury-rich liquid in the intergranular regions.

5. The lamp of claim 1 wherein said amalgam is binary.

6. The lamp of claim 1 wherein said amalgam exists in both solid and liquid phases when the lamp is operating and wherein the mercury concentration is less than 50 weight percent in the solid phase and more than 50 weight percent in the liquid phase.

7. A temperature controlled fluorescent lamp having a predetermined amount of mercury sealed therein characterized in that the mercury is in the form of a binary zinc amalgam that is partially in the liquid and partially in the solid phase when the lamp is operating.

8. The lamp of claim 7 wherein the mercury in said amalgam is between about 40 and 60 weight percent.

9. The lamp of claim 7 wherein the weight percent of mercury in said amalgam is significantly greater in the liquid phase than in the solid phase.

10. The lamp of claim 7 wherein the mercury is >90 weight percent in the liquid phase.

11. A temperature controlled fluorescent lamp having a predetermined amount of mercury sealed therein characterized in that the mercury is a solid amalgam at room temperature.

12. The lamp of claim 11 wherein said amalgam includes zinc.

13. The lamp of claim 12 wherein said amalgam is binary.

14. The lamp of claim 13 wherein the mercury in said amalgam is between about 40 and 60 weight percent.

15. The lamp of claim 14 wherein said amalgam is in pellets with interiors having mercury-rich liquid portions.

16. The lamp of claim 15 wherein said pellets have an outer shell with a zinc-rich portion.

17. A lamp fill material for a fluorescent lamp characterized in that the fill material includes pellets of zinc amalgam in about 5 to 60 weight percent mercury.

18. The lamp fill material of claim 17 wherein said pellets are each between 0.05 and 25 milligrams in mass.

19. The lamp fill material of claim 17 wherein said pellets are in a metastable, non-equilibrium state.

20. The lamp fill material of claim 17 wherein said amalgam further comprises less than 10 weight percent of one or more elements taken from the group consisting of bismuth, lead, indium, cadmium, tin, gallium, strontium, calcium and barium.

21. A fluorescent lamp characterized in that mercury in the lamp is in the form of a zinc amalgam which exists in both solid and liquid phases when the lamp is operating and wherein the mercury concentration is less than 50 weight percent in the solid phase and more than 50 weight percent in the liquid phase.

22. A fluorescent lamp characterized in that mercury in the lamp is in the form of an amalgam which does not significantly control the mercury vapor pressure of the lamp when operating.

23. The lamp of claim 22 wherein the amalgam exists in both solid and liquid phases when the lamp is operating with the weight percent of the mercury in the liquid phase is significantly greater than in the solid phase.

24. A fluorescent lamp having a predetermined amount of mercury sealed therein characterized in that the mercury is a solid amalgam at room temperature and in which the amalgam does not, when operating, significantly reduce the vapor pressure in the lamp below the vapor pressure which would exist were the amalgam not present.

25. The lamp of claim 24 wherein said amalgam includes zinc.

* * * * *